United States Patent [19]

Wright

[11] Patent Number: 4,646,517

[45] Date of Patent: Mar. 3, 1987

[54] HYDRAULIC WELL PUMPING APPARATUS

[76] Inventor: Charles P. Wright, Rt. 1, Box 371, Diana, Tex. 75640

[21] Appl. No.: 483,818

[22] Filed: Apr. 11, 1983

[51] Int. Cl.[4] ..... F16D 31/02

[52] U.S. Cl. ..... 60/371; 60/369; 91/6; 91/275; 91/350; 92/114

[58] Field of Search ..... 60/372, 371, 387, 369, 60/373; 92/114; 91/454, 6, 275, 350; 166/77.5

[56] References Cited

U.S. PATENT DOCUMENTS

| | | | |
|---|---|---|---|
| 1,001,282 | 8/1911 | Kimber | 92/114 |
| 2,355,669 | 8/1944 | Moser | 92/114 |
| 2,582,264 | 1/1952 | Schneck et al. | 60/372 |
| 3,335,640 | 8/1967 | Conrad | 60/371 |
| 4,347,049 | 8/1982 | Anderson | 60/372 |
| 4,414,808 | 11/1983 | Benson | 60/372 |
| 4,449,896 | 5/1984 | Klepper et al. | 60/369 |

*Primary Examiner*—Edward K. Look

[57] ABSTRACT

For use with a pumped well having a string of sucker rods connecting to a downhole pump, hydraulic pumping apparatus is disclosed. In the preferred and illustrated embodiment, a polished rod is surrounded by a selectively located sleeve. The sleeve locks to a piston in a hydraulic cylinder. The piston is forced upwardly. The length of stroke is adjusted. The location of the sleeve on the polished rod is likewise adjustable. This enables the device to be adjusted so that any length of sucker rods can be accommodated without requiring cutting sucker rods to achieve a particular length. Moreover, the length of stroke is adjustable to take into account the stroke of the pump and sucker rod elongation during operation.

17 Claims, 3 Drawing Figures

HYDRAULIC WELL PUMPING APPARATUS

BACKGROUND OF THE DISCLOSURE

Pumping oil wells are normally pumped with a string of sucker rods. The standard equipment installed in the field is ordinarily a walking beam connecting with a polished rod which in turn connects to the string of sucker rods. Sucker rods come in standard lengths. The last two or three sucker rods, however, typically must be cut short to enable the sucker rod string to land the pumping element at a specified depth in the well.

Consider a well of 10,000 feet in depth. Elongation of 0.10% in the sucker rod string corresponds to ten feet of elongation. Consider a well which has a depth wherein the sucker rod string at the time of installation requires the last sucker rod to be shortened by twelve feet. The two factors just mentioned (sucker rod elongation during operation and obtaining a precise length of sucker rods between the pump and the walking beam) create significant problems in matching up the sucker rod string both at the time of installation and during operation. This is a problem at the time of installation, and it may very well become a problem long after installation has occurred. For instance, sucker rods do elongate with use, and the sucker rod string may therefore have to be shortened.

There are hydraulic operated walking beam mechanisms. They operate primarily as a replacement for the power plant which has been heretofore a walking beam power plant.

The present invention is directed to an improvement in power plants for a downhole pump. It is particularly advantageous in that it is able to be connected directly to the casing at the well head and thereby enable the device to attach directly to the well head at the Christmas tree location, permitting direct connection of the sucker rod string to a polished rod as disclosed herein, thereby permitting adjustments in the sucker rod elevation. Moreover, the length of stroke can be adjusted quite readily.

All of these adjustments are accomplished with a view of providing a hydraulically powered well pumping apparatus which overcomes the problems mentioned above. That is, it can be installed directly on the top of the casing at the well head and operates in such a manner that a polished rod stuffing box is not required. Not only does installation proceed in a more easy fashion, the device further enables the polished rod to be installed in the sucker rod string without going to special efforts to cut and trim sucker rods to obtain a precise length. Further, the length of stroke is adjustable. Because of these adjustments, the problems arising in the installation are markedly reduced. Should there be permanent elongation of the sucker rod string, that also can be accommodated at the time of workover, thereby enabling the relative location of the pump at the end of the string to be modified or the length of stroke to be modified, these two adjustments being accomplished quite easily in the field without pulling the entire sucker rod string. This is advantageous at workover, months or years after the sucker rod string has been installed in the well.

With the foregoing in view, one feature of this apparatus is to provide a hydraulic powered well pumping system for operation of a downhole pump connected to the pumping apparatus by sucker rod string. Through the use of a pressure accumulator in the hydraulic system, energy peaks are reduced. Rather than require large energy peaks on the upstroke (lifting thousands of feet of sucker rods), the device operates at a more constant load by incorporation of a hydraulic accumulator in the high pressure side of the power system. The accumulator is filled and pressurized to a very high pressure. When the sucker rod string is lifted hydraulically, the accumulator dumps oil into the hydraulic lifting apparatus, thereby hoisting the entire sucker rod string. This is accomplished with a reduced peak load. It enables the reduction of the power plant capacity by perhaps 40% and maintains harmonic balance on the sucker rod string from great depth of 6,000 to 10,000 feet.

Other features and advantages of the present apparatus will be more readily apparent upon review of the detailed description which is set forth below. The apparatus is briefly summarized as a hydraulically powered piston in a cylinder surrounding a sleeve. The sleeve is adjustably fixed to a long polished rod. A hydraulic power system is also incorporated.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
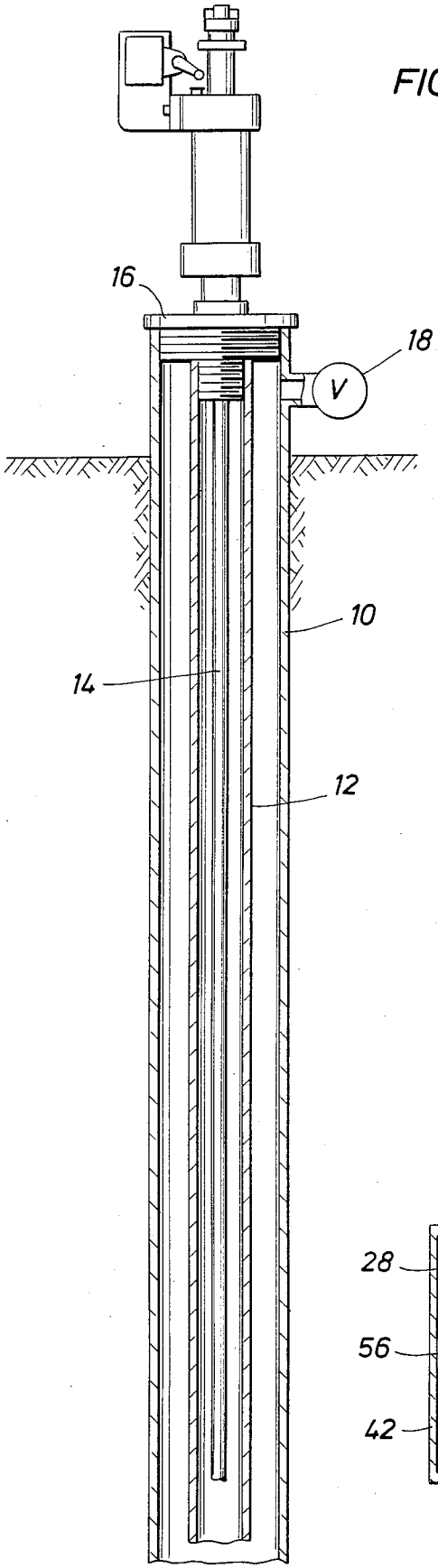
FIG. 1 discloses a pumped well incorporating a sucker rod string wherein the well is pumped by the improved hydraulic pumping apparatus of this disclosure.

Attention is first directed to FIG. 1 of the drawings. A pumping well is shown. The well is cased with a casing 10 which extends to some selected depth in the well. There is a string of production tubing 12 in the well. The tubing 12 extends downwardly to the pump which is located at a depth in the well to pump produced oil or water or both. Pumping is achieved by reciprocation of a sucker rod string 14. The sucker rod string is assembled by threading together a number of sucker rods. Threaded connections in the sucker rod string have been omitted. The casing is connected to a well head apparatus which is identified by the numeral 16. To this end, the casing is connected through a valve 18 for access to the casing. The tubing string 12 connects to a valve (not shown) to deliver pumped oil to a collection line. The valve 18 is typical of the valves which are located at the well head apparatus. Moreover, the well head apparatus 16 may include other valves, it being appreciated that the well head apparatus 16 can take a variety of shapes and forms. Primarily, the well head apparatus 16 includes a mechanism for mounting the present invention as better shown in FIG. 2, and also incorporates means for mounting this equipment in line with and directly adjacent to the casing. As will be described in detail regarding FIG. 2, the well head apparatus 16 additionally includes means for connecting with the tubing string 12.

Figure 2:
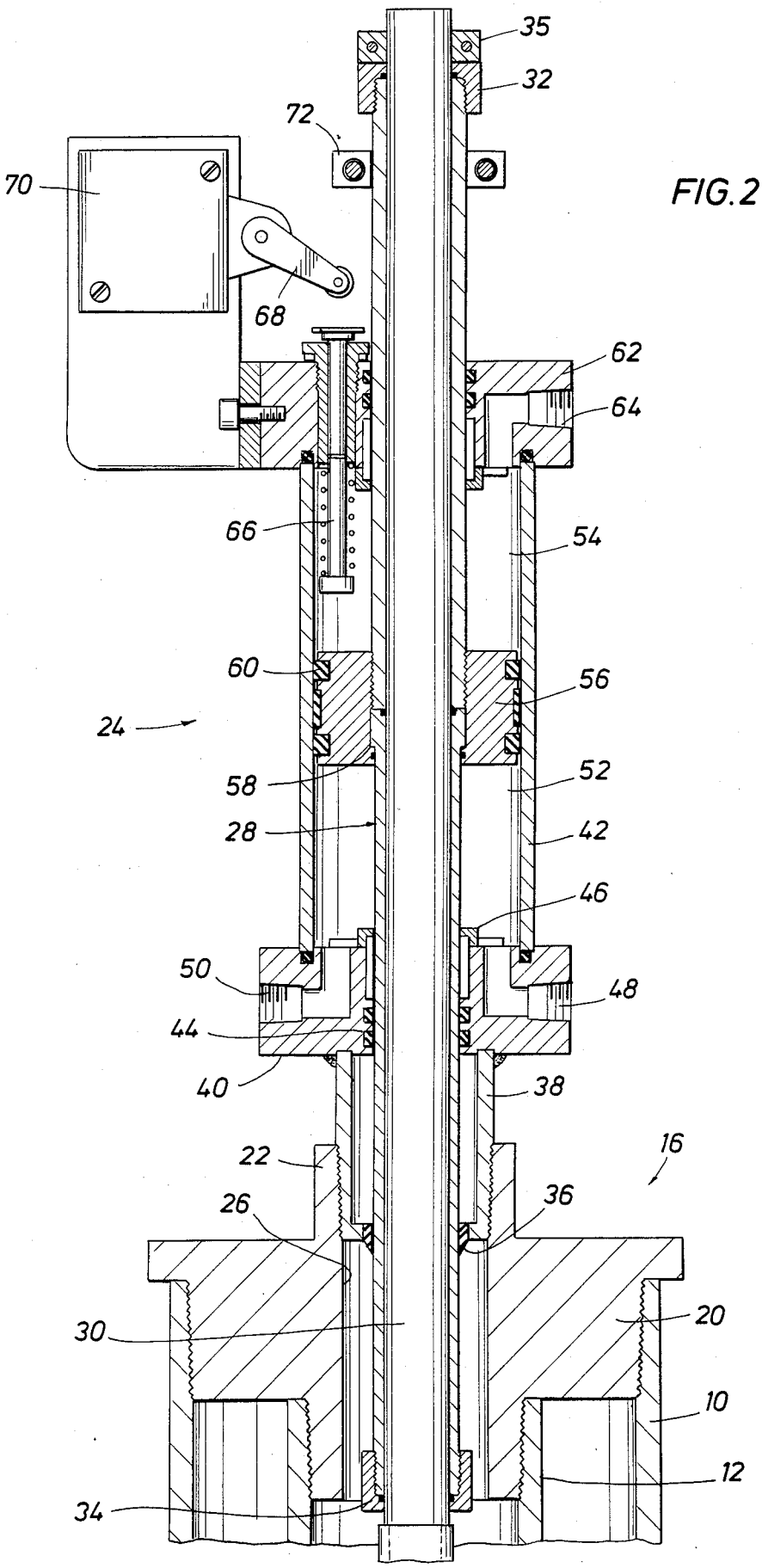
FIG. 2 of the drawings is an enlarged detailed view of the hydraulic pumping apparatus of this disclosure shown in sectional view and further including means for connecting the hydraulic pumping apparatus to the casing at the point of installation.

The well head connective apparatus is shown in FIG. 2 of the drawings to include a large body 20 which threads to the casing 10. The body also threadedly supports and connects with the tubing string 12. The annular space between the large casing 10 and the tubing string 12 defines an annular cavity around the tubing string. Spacing between the tubular members 10 and 12 is defined by the location of the threads concentric to one another on the body 20. The body 20 incorporates an upstanding threaded collar 22. The collar 22 is internally threaded to receive and support the hydraulic pumping apparatus thereabove. That apparatus is identified generally with the numeral 24.

The body 20 is axially hollow and has a rather large diameter passage therethrough identified by the numeral 26. It is sufficiently large to receive a reciprocating sleeve 28. The sleeve 28 fits around a polished rod 30. The rod is relatively long. It is the topmost rod in the sucker rod string. The rod is provided with a cylindrical outer face which is highly polished. This enables the rod 30 to pass through various packings and maintain a seal within tubing string 12. The polished rod connects at its lower end to a suitable joint with the sucker rod string. The polished rod is made relatively long. Assume that the polished rod 30 is installed in a sucker rod string having a maximum stroke of eight feet. Assume further that this string of sucker rods is made of sucker rods having a length of twenty-five feet. To avoid the necessity of cutting the topmost sucker rod to enable the length of sucker rods to accommodate a particular elevation relative to the pump, it is permissible to use a very long polished rod, perhaps forty feet in length. In this instance, the sucker rod string can be raised or adjusted by one full rod length or any fraction thereof. This range of adjustment enables the sucker rod string to be quickly located in the well. It is no longer necessary to look for odd length sucker rods, or to cut off a sucker rod to accommodate the end of the sucker rod string to the pumping apparatus. In other words, trimming of finite lengths of sucker rods is no longer required, the present apparatus enabling the polished rod 30 to serve as an adjustable portion in the sucker rod string, the mode of adjustment to be described below.

Not only is there a need for adjustment in the sucker rod string length to locate the pump at the right elevation, there is also a need to adjust the location of the polished rod to accommodate different strokes. Assume that the device may be operated for a while with a five-foot stroke. Later on, it is determined that the stroke should be seven feet. Later, the stroke may be changed to three feet. Many stroke lengths can be imagined; this apparatus enables the stroke length to be adjusted, the mechanism for adjustment compensating for changes in stroke length as well as the location of the polished rod in the sucker rod string.

The sleeve 28 is affixed to the polished rod temporarily. At the upper end, the sleeve incorporates a cap 32 which is tightened and snugly grips the polished rod. A similar cap 34 is located at the lower end of the sleeve. The two caps releasably fasten the sleeve to the polished rod. Suitable seals are incorporated in the caps 32 and 34 forming a fluid tight seal about the polished rods. As they are tightened, they increase a circumferential grip around the sleeve which in turn grips the polished rod 30. This enables the sleeve 28 to be located at any point along the length of the polished rod.

A conventional polished rod clamp 35 is attached to the polished rod 30 above the cap 32. The rod clamp 35 is in abutting contact with the top of the cap 32. The weight or load of the sucker rod string is supported at the point of contact between the rod clamp 35 and cap 32.

The sleeve 28 passes through a wiper seal 36. The wiper seal 36 is located at the base of an adapter tube 38. It extends upwardly to a lower cylinder head 40. The cylinder head 40 is located above the body 20 and is parallel to it. It supports an upstanding cylinder 42. The cylinder head is axially hollow and is constructed with a set of seals at 44. It supports a bumper 46 at the top axial opening. The cylinder head 40 incorporates a first tapped opening 48 and a second tapped opening 50. The two are identical. As a convenience to the hydraulic circuitry, two are provided and they are both relatively large, thereby transferring hydraulic oil under pressure into a lower chamber 52. The cylinder is divided into two chambers, the upper chamber being identified by the numeral 54. They are separated by a piston 56. The piston 56 locks to the sleeve 28. This locking arrangement is achieved at a shoulder 58. The shoulder 58 secures the piston 56 so that the piston is able to lift the sleeve and hence the entire sucker rod string. The piston 56 incorporates suitable seals 60 on its outer periphery to enable it to move in the cylinder 42.

A single acting piston is all that is required. The lower chamber 52 is filled with oil under pressure to lift the sucker rod string. The upper chamber is closed by an upper cylinder head 62, and a port 64 admits oil. Oil is not required in the upper chamber but it is delivered occasionally by means of an oiler (not shown) which simply lubricates the upper end wall of the cylinder 42. This is a protective step. The upper chamber also includes a push rod 66. The rod 66 is spring loaded downwardly. It is bumped by the piston 56 in its travel. The length of the rod 66 can be adjusted. When it is bumped, it conveys motion by pushing against an arm 68 for operation of an hydraulic valve 70. This will be described in greater detail hereinafter. The arm 68 is bumped by a ring 72 fastened about the sleeve. The spacing of the ring 72 determines travel. The ring 72 and the push rod 66 collectively adjust the stroke of the equipment. The stroke can be lengthened by raising the lock ring 72. Typically, it is constructed of a ring which encircles the sleeve 28, and the ring is made in two halves. The two halves are joined together by suitable bolts.

The push rod 66 is also adjustable. It can be shortened or lengthened. For instance, it can be lengthened to thereby shorten the stroke of the piston 56.

The upper cylinder head 62 includes various seals around the sleeve 28. It will be further observed that the sleeve 28 is made of two parts, the two parts threading together at the piston 56. This is a convenience to enable the length of the sleeve to be adjusted at the time of manufacture. The sleeve can be changed in the field to thereby alter the length of the sleeve.

Figure 3:
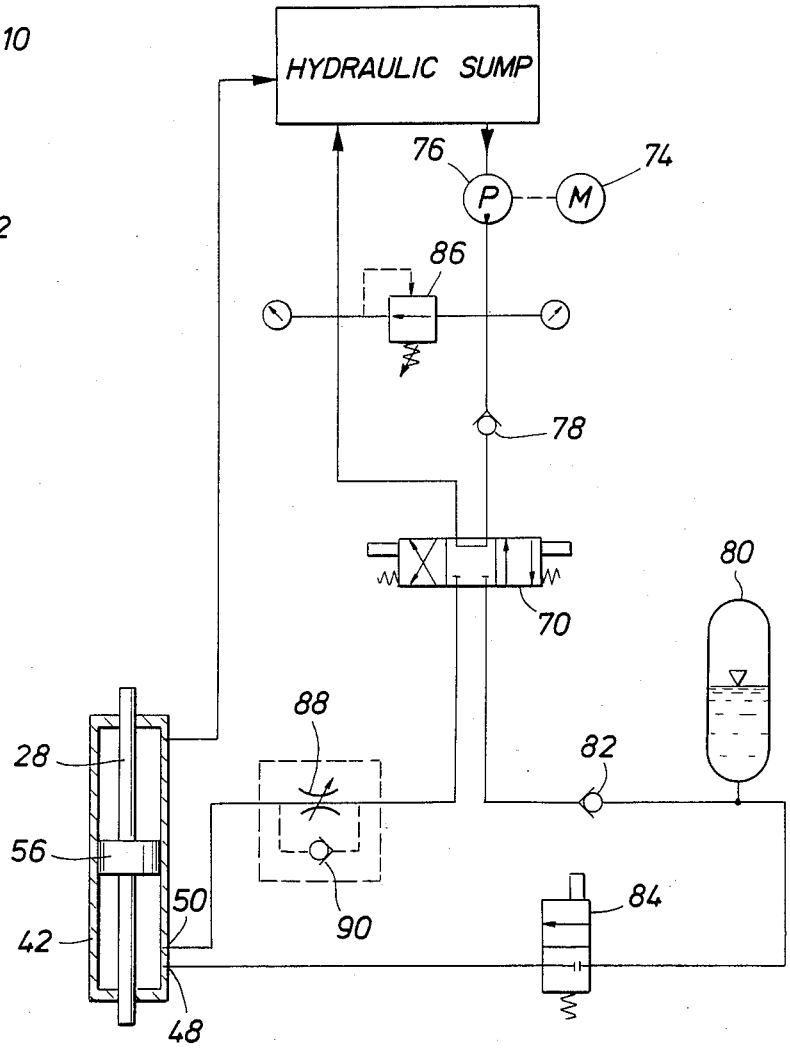
FIG. 3 is a hydraulic schematic of the well pumping apparatus of this disclosure.

Attention is momentarily directed to FIG. 3 of the drawings which shows the hydraulic circuit of this equipment. In FIG. 3, the numeral 42 still indicates the cylinder which encloses the piston 56. The lower cylinder head includes the ports 48 and 50. One is used to connect to one flowline and the other is connected to another flowline. Additionally, the valve 70 is shown in FIG. 3 as will be explained.

FIG. 3 incorporates a suitable motor 74 which drives a pump 76. The pump is connected to a sump at its input, and it delivers hydraulic oil under pressure to an outlet line. The oil under pressure flows through a check valve 78 and then to the three-position control valve 70. The control valve 70 has spring bias means incorporated with it to assure that it holds a detent in the three illustrated positions. As shown in FIG. 3, no oil flows through the valve 70. Oil is directed through the valve 70 when the sucker rod string is to be raised. Oil flows under high pressure through the check valve 78, the valve 70 and through another check valve to an accumulator 80. The check valve 82 is in the line to prevent backflow. The high pressure fluid passes through a shut-off valve 84 to the inlet port 48. High pressure is controlled by an adjustable pressure regulator 86. The regulator 86 is adjusted and, in conjunction with the pressures achieved in the accumulator 80, to control the rate at which the sucker rod string is raised. In other words, oil is admitted under pressure from both the pump 76 and from the accumulator 80 to raise the sucker rod string. The rate at which it is raised is adjustable by adjusting the regulator 86 or the capacity of the accumulator. While this adjusts the rate at which the rod 30 is raised, it is important also to adjust the rate at which the sucker rod string moves downwardly. The sucker rod string moves downwardly when the piston 56 is permitted to fall. This occurs when hydrayulic flow from the valve 70 is interrupted. Oil is forced out of the lower chamber 52 at a controlled rate. This rate is controlled by an adjustable orifice 88 which directs the hydraulic oil flowing out of the lower chamber 52 to the reservoir via an air transfer cooler (not shown).

The port 50 connects through the adjustable orifice 88. This orifice is protected by a check valve 90 connected around the orifice. The rate of fall of the piston is determined by the setting of the adjustable orifice 88. The rate of fall is thus adjustable to avoid slamming the sucker rod string. The rate at which the piston 56 rises is also adjustable. Both motions can be adjusted manually to thereby control the cycle time of the device. The cycle time in part depends on the length of stroke; the length of stroke can be adjusted by altering the location of the two bumpers which operate the control valve 70. It is possible to adjust the device to operate at a very high rate of speed, or to slow down the speed by tenfold or greater. In this manner, the stroke speed may be entirely controlled by making simple manual adjustments as required.

The valves 70 and 84 are thus conventional "bought" items and operate in the conventional manner for such valves. Consider the operation of the equipment. Momentarily, ignore all of the circuitry from the check valve 82 through the accumulator 80, the valve 84 and the port 48. With the valve 70 in the center position (no power to either solenoid), the pump 76 simply pumps oil through the valve 70 and back to sump. No work is accomplished.

At the beginning of the upstroke, travel is detected by the switches which detect proximity of the pumping apparatus and a signal is formed for operation of the solenoid valve which operates in the customary manner. For the upstroke, the valve 70 is solenoid switched to the left hand position. Valve position delivers hydraulic oil for lifting. The oil flows from the pump 76, through valve 78, through valve 70, and reverse flows through the check valve 90. The lifting stroke is powered by oil under pressure introduced through the port 50 and the piston 56 is lifted.

The lifting stroke continues until the stroke has been finished and proximity detected. The downstroke begins when the solenoid valve 70 is switched to the opposite position. On downstroke, the oil below the piston 56 is metered through the restricted orifice 88 and flows through the valve 70 to sump. The downstroke rate is regulated by the adjustment of the orifice 88, thereby avoiding a jarring downstroke.

During downstroke, the pump 76 continues to operate. That is when the accumulator comes into play. While it is possible to return the pump output to sump through the use of a pressure regulated dump valve, it is more efficient to use a smaller powerplant to store energy in the accumulator 80. Therefore, for downstroke, the valve 70 is switched so that the pump 76 is connected through the valve 70 to deliver oil to the accumulator 80. The port 48 is blocked by switching the valve 84 to the blocking position. Thus, during downstroke, the pump stores oil in the accumulator 80. As the accumulator is brought up to some substantial pressure, that pressure is held because the valve 84 was closed. On the next upstroke, oil for lifting is delivered from two sources, one being directly from the pump 76 (described above), and the second source being oil under pressure from the accumulator 80 through the valve 84. Reverse flow is denied by the check valve 82. Therefore, a smaller power plant is required as a result of incorporating the accumulator.

Consider a typical installation problem. Assume that the sucker rods that are available are precisely 5000 feet in length. Assume further that the requisite distance between the well head and the pump to be spanned by the sucker rod string is 5018 feet. Assume further that the maximum stroke is ten feet. In this instance, the polished rod 30 is installed so that the rod has eighteen feet of its length below the well head equipment. This covers the requisite odd length to match the sucker rod string to the actual depth of the pump. Assume further that the length of stroke is ten feet. Eighteen feet of the length of the polished rod is located below the equipment to function as the odd length required for the sucker rod string and approximately ten feet are required for the stroke. Allowing another two or three feet above the equipment, this particular example would require a polished rod of about thirty-two feet or thirty-three feet in length. This is more than suitable because it then enables the equipment to be adjusted for subsequent changes in workover of the well.

Assume that the same well described above is serviced two years after it is first installed. Assume that in that two-year interval the sucker rod string elongates permanently by three feet. Assume further that the stroke must be shortened by two feet. The first change is easily accommodated simply by raising the polished rod 30 relative to the sleeve 28 by three feet to take up the elongation in the sucker rod string. The second change is accommodated by relocating the rod clamp 35 so that it is in abutting contact with the top of the cap 32. Both of these changes can be accomplished in quick and easy order. Primarily, they are accomplished by using a simple workover rig to raise and hold the sucker rod string. This can be achieved by simply grasping the upper end of the polished rod 30 and raising it to the required elevation. After it has been raised, the caps 32 and 34 can be adjusted by first loosening and thereafter retightening to relocate the caps and hence the sleeve. The rod clamp 35 is then loosened and relocated above the cap 32. This completely changes the construction of the sucker rod string to accommodate all the changes or adjustments that are necessary.

While the foregoing is directed to the preferred embodiment, many changes and alterations can be made without departing from the spirit and scope of the disclosed apparatus. Suitable claims are appended below.

What is claimed is:

1. Hydraulic powered well pumping apparatus for operation of a sucker rod well pump in a well borehole, the apparatus comprising:

(a) an elongate polished rod having upper and lower ends, said rod being aligned above and adapted to connect to a string of sucker rods in a well borehole therebelow;

(b) an adjustably positioned sleeve means aligned above and enclosing a portion of said polished rod and having a shorter length than said polished rod to enable said polished rod to extend above said sleeve means and below said sleeve means for connection to the string of sucker rods in the well borehole;

(c) an axially hollow upstanding cylinder slideably receiving said sleeve means therethrough and enclosing a piston therein, said piston being:

(1) moved on admitting hydraulic oil to said cylinder, and (2) joined to said sleeve means for moving said sleeve means and thereby moving said polished rod;

(d) means for mounting said upstanding cylinder directly aligned with and above a casing at the top of a well adapted to have a sucker rod string positioned therein;

(e) means for adjusting the stroke length imparted to said sucker rod string between minimum and maximum stroke lengths; and (f) means for adjusting the location of said sleeve means relative to said polished rod to vary the relative length of polished rod below said sleeve means and wherein a portion of said polished rod extends above said sleeve means dependent on the relative respective portions thereof.

2. The apparatus of claim 1 wherein said piston is located in said cylinder and has a range of travel adjustable to a maximum determined by the length of said cylinder.

3. The apparatus of claim 1 wherein said sleeve means releasably clamps to said polished rod to adjust in location along said polished rod.

4. The apparatus of claim 3 wherein said sleeve means includes surrounding releasably constructed ring clamps to grip and hold said polished rod.

5. The apparatus of claim 4 wherein said sleeve means includes upper and lower ring clamps.

6. The apparatus of claim 5 wherein said sleeve means is axially aligned with and centrally concentric of said cylinder and said piston is fixedly joined thereto.

7. The apparatus of claim 1 wherein said stroke length adjusting means includes:

(a) first position sensing means operated on continued upstroke of said piston to sense upward movement of said piston; and (b) second position sensing means operated on continued downstroke of said piston to sense downward movement of said piston.

8. The apparatus of claim 7 wherein one of said sensing means comprises a contact rod positioned to be moved on upstroke of said piston.

9. The apparatus of claim 7 wherein one of said sensing means comprises a lock ring adjustably mounted on said sleeve means positioned to be moved on downstroke of said piston.

10. The apparatus of claim 1 wherein said piston includes an upwardly facing shoulder means thereon for supporting said sleeve means in a locked relationship.

11. The apparatus of claim 10 wherein said sleeve means is formed of an elongate hollow sleeve fitting around said polished rod and adapted to seal to said piston supported on said shoulder means.

12. The apparatus of claim 10 wherein said sleeve means includes at least two elongate hollow sleeves fitting around said polished rod and adapted to seal to said piston supported on said shoulder means.

13. The apparatus of claim 1 wherein said mounting means includes a body with a casing connector on the nether side thereof and also a tubing string connector for positioning said cylinder aligned with and over said tubing string.

14. The apparatus of claim 13 further including an upstanding hollow cylinder head for connecting said cylinder above said body, said cylinder head sealing against said cylinder to form a closed hydraulic oil receiving chamber beneath said piston.

15. The apparatus of claim 14 further including a pair of fluid line openings into said cylinder head communicating with the chamber to admit oil for raising said piston.

16. The apparatus of claim 15 further incorporating an oil flow line from a source connected at one of said openings.

17. Hydraulic powered well pumping apparatus for operation of a sucker rod well pump in a well borehole, the apparatus comprising:

(a) an elongate polished rod having upper and lower ends, said rod being aligned above and adapted to connect to a string of sucker rods in a well borehole therebelow;

(b) well head closure means adapted to close the upper end of the well borehole, said closure means having an aligned opening for said polished rod to enable said polished rod to extend above said closure means and below said closure means to enable connection to the string of sucker rods in the well borehole;

(c) an axially hollow upstanding cylinder above said closure means and slideably receiving said polished rod therethrough and enclosing a piston therein, said piston being:

(1) moved on admitting hydraulic oil to said cylinder, and (2) releasably joined to said polished rod for moving in said cylinder to thereby move said polished rod;

(d) means for mounting said upstanding cylinder directly above said closure means and above a well adapted to have a sucker rod string positioned therein;

(e) means for adjusting the stroke length of said piston in said cylinder to adjust the stroke length of the sucker rod string between minimum and maximum stroke lengths; and (f) means for adjusting the location of said piston relative to said polished rod to vary the relative length of polished rod below said piston and wherein a portion of said polished rod extends above said piston dependent on the relative respective portions thereof.

* * * * *